United States Patent [19]

O'Brian

[11] 4,047,495

[45] Sept. 13, 1977

[54] CHILD RESISTANT DISPENSING CLOSURES

[75] Inventor: Edward D. O'Brian, Anaheim, Calif.

[73] Assignee: Polytop Corporation, Slatersville, R.I.

[21] Appl. No.: 682,607

[22] Filed: May 3, 1976

[51] Int. Cl.[2] ..... B65D 55/02

[52] U.S. Cl. ..... 215/224; 220/281; 220/306

[58] Field of Search ..... 222/556, 153, 402.11, 222/498; 215/216, 224; 220/281, 306

[56] References Cited

U.S. PATENT DOCUMENTS

| | | | |
|---|---|---|---|
| 3,556,331 | 1/1971 | Towns | 215/216 X |
| 3,604,585 | 9/1971 | Towns | 215/216 X |
| 3,845,872 | 11/1974 | Towns et al. | 215/224 X |

*Primary Examiner*—Stanley H. Tollberg

[57] ABSTRACT

A dispensing type container closure having a lid pivotally mounted on the closure so as to be capable of being moved between a closed position in which the lid closes off an opening through the top of the container and an open position in which this opening is uncovered can be made child resistant in character by including a recess in the top of the closure into which the lid is adapted to fit so that in the closed position the lid cannot be manually engaged to be rotated from the closed position. A fulcrum is provided within the recess and the lid is made so that when the lid is in the closed position pressure can be applied to the lid in order to pivot or move a portion of the lid remote from where the lid is hinged on the closure to a sufficient extent so that this portion of the lid can be manually engaged and moved from the closed position. Preferably a toggle structure is employed to connect the lid and the closure so as to hold the lid in either the closed or the open position. A part of this toggle structure is employed to increase the flexibility of the lid so as to facilitate pressure being applied to move the lid from the closed position.

4 Claims, 4 Drawing Figures

CHILD RESISTANT DISPENSING CLOSURES

CROSS REFERENCE TO RELATED PATENTS

Towns U.S. Pat. No. 3,398,847, issued August 27, 1968, entitled "CONTAINER AND SAFETY CLOSURE THEREFORE"; Hazard U.S. Pat. No. 3,655,103, issued Apr. 11, 1972, entitled "SAFETY DISPENSING CLOSURES"; Towns U.S. Pat. No. 3,604,585, issued Sept. 14, 1971, entitled "CONTAINER AND SAFETY CLOSURE SEAL"; Hazard U.S. Pat. No. 3,877,598, issed Apr. 15, 1975, entitled "CLOSURE STRUCTURES HAVING CHILD-SAFETY FEATURE"; and LaVange U.S. Pat. No,. 3,881,643, issued May 6, 1975, entitled "CHILD RESISTANT CLOSURES WITH LEVER OPENING".

BACKGROUND OF THE INVENTION

The invention set forth in this specification pertains to new and improved dispensing type container closures. More specifically it pertains to closures as indicated which are of a child resistant character.

The term "dispensing closures" was originally primarily used to designate closures employing spouts mounted so as to be capable of being moved between open and closed positions. As time has progressed the term dispensing closures is being increasingly utilized to designate not only closures having such spouts but in addition closures carrying pivotally mounted lids capable of being moved between open positions in which openings through these closures are uncovered and closed positions in which these openings are covered. The invention set forth in this specification pertains to dispensing closures of the latter category.

As the field of dispensing closures employing rotatable lids has developed certain types of such closures have been considered as more desirable than others. At the present time it is felt that a lid-type dispensing closure to be acceptable in the marketplace should employ a structure in which the inherent mechanism of the closure will tend to hold the lid used in the closure in either a completely closed or a completely open position. Closures of this category have been proposed which utilize a toggle type mechanism or structure extending between the closure lid and the side of the closure adjacent to the top of the closure. Such a toggle structure operates so as to prevent the lid of such a closure remaining in other than an open or a closed position when the lid is not engaged by the hand of the user.

As there have been increasing demands for closures of a so called child resistant character—i.e., closures which are relatively difficult for children and for persons with decreased mental capacity to open, but which can be opened by normal adults—the dispensing closure industry has faced a very severe problem in providing such closures. A number of efforts have been made at this objective. It is not considered that an understanding of the present invention requires a detailed review of such efforts. In general, the efforts at providing child resistant dispensing closures having rotatable lids have resulted in the production of closures which are considered to be undesirable for one or more of any of a number of different reasons.

Certain of such prior lid-type closures have been relatively complex and hence difficult to mold out of somewhat resilient polymers such as the grades of polyethylene, polypropylene or the like as have been conventionally employed in the manufacture of dispensing closures. Certain of such closures have been relatively difficult to assemble in a final, operative configuration. Other of such closures have been somewhat undesirable because of their appearance. Further, certain of such prior lid-type closures have been undesirable because they are too difficult for normal adults to conveniently open.

BRIEF SUMMARY OF THE INVENTION

An objective of the present invention is to provide new and improved dispensing type container closures. More specifically the invention is intended to provide new and improved closures as indicated of a child resistant character. In its more limited aspects the invention is intended to provide lid-type dispensing closures of a child resistant character, each of which utilizes a toggle means or structure which serves to hold the lid in such a closure in either an open or closed position and which also facilitates the use of the closure as child resistant closure. Further objects of the present invention are to provide closures as described which may be easily and conveniently manufactured at a comparatively nominal cost, which may be assembled on containers in an established manner with a minimum chance of such closures being damaged during such assembly, which are of an effective child resistant character, and which are capable of being utilized over a prolonged period without difficulty by an average adult.

In accordance with this invention a container closure having a top with an opening extending therethrough, means for mounting the top on a container attached to the top and extending around the opening, hinge means secured to the top, a lid secured to the hinge means so as to be capable of being rotated between a closed position in which the lid overlies the top and covers the opening, and an open position in which the opening is exposed is provided with the improvement which comprises: a recess having a bottom located in the top of the container, a fulcrum located between the hinge and the opening extending from the bottom of the recess upwardly into the recess, the lid fitting within the recess when in its closed position so that the lid cannot be manually engaged to be lifted from the closed position, at least a portion of the lid between the fulcrum and the hinge being sufficiently flexible so as to be capable of being restored when the lid is in the closed position by the application of pressure applied from above the lid to the area of the lid generally between the fulcrum and the hinge to a sufficient extent so that a portion of the lid remote from the hinge and the fulcrum projects from the recess a sufficient extent so as to be capable of being manually engaged so that the lid can be moved to the open position.

A container closure in accordance with this invention preferably utilizes a toggle means connecting the lid and the top for controlling the position of the lid so that the lid is held by the action of the toggle means in either the closed or the open position when it is not engaged as, for example, by the hand of the user so as to be located in some intermediate position. Preferably such a toggle means is located with respect to the lid so as to provide a linelike area extending along the lid which is of a relatively weakened or flexible character so as to facilitate distortion so as to result in the lid being moved a sufficient extent so that a portion of it can be manually engaged as indicated in the preceding.

BRIEF DESCRIPTION OF THE DRAWING

The invention set forth herein is best more fully described by referring to the accompanying drawing in which.

Figure 1:
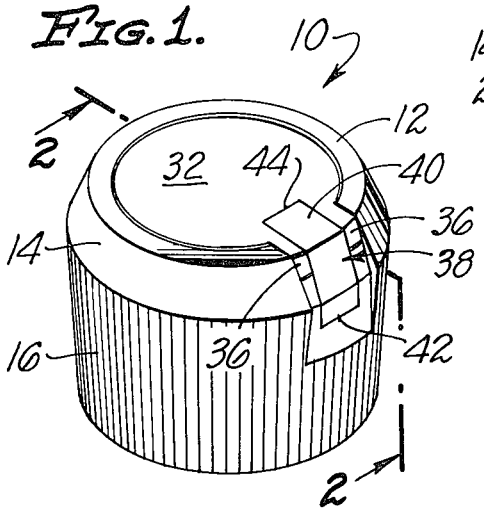
FIG. 1 is an isometric view from the rear of a presently preferred embodiment or form of a dispensing closure of the invention with the lid of such closure in a closed position.

The particular closures illustrated in the drawing employ certain operative concepts and principles as are set forth and defined in the appended claims. It is considered that these concepts or principles can be easily embodied within other somewhat differently appearing and/or constructed closures through the use or exercise of routine design or engineering skill in the field of dispensing closures.

DETAILED DESCRIPTION

In the drawing there is shown a dispensing closure 10 which includes a top 12 having a slightly tapered side 14 appearing as an extension of a nearly cylindrical skirt 16. This skirt 16 is provided with an internal bead 18 adapted to fit within a correspondingly shaped groove (not shown) on a container (not shown) so as to hold the closure 10 in place. Within the skirt 16 an annular sealing plug or flange 20 is located on the undersurface 22 of the top 12 in such a manner as to extend around an opening 24 in the top 12. Various equivalents of the bead 18 and the flange 20 for holding the closure 10 in a sealed manner on a container can be employed.

Figure 2:
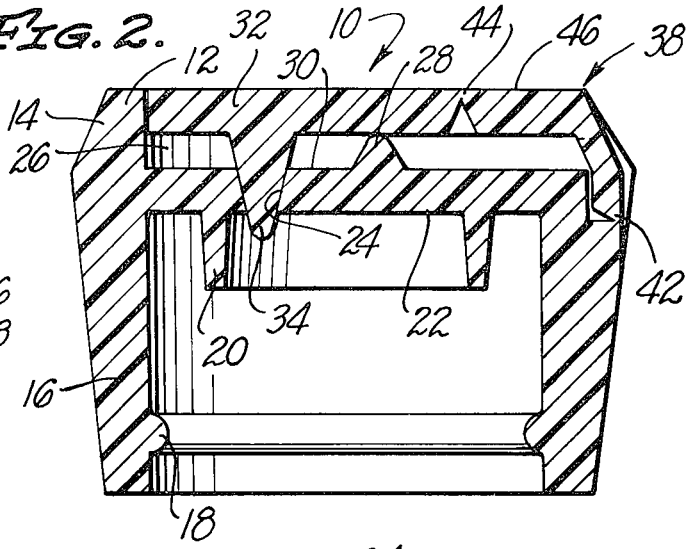
FIG. 2 is a cross-sectional view taken at line 2—2 of FIG. 1.

This opening 24 leads through the top 12 into a more or less disk-shaped recess 26 located within this top 12. An elongated fulcrum 28 having more or less the shape of an elongated, rounded projection extends from the bottom 30 of the recess 26 into this recess 26. This fulcrum 28 is of less height than the depth of the recess 26 so that a lid 32 may be accommodated within the recess 26 as shown in FIGS. 1 and 2. When this lid 32 is in a position as indicated in FIGS. 1 and 2 it is in what may be referred to as a closed position.

In this closed position no part of the lid 32 is exposed in such a manner that the lid 32 can be manually engaged or engaged by any tool or implement approximately so as to be moved from the closed position illustrated. In this closed position a plug or closure member 34 extends from the lid 32 so as to fit within the opening 24 in such a manner as to close this opening 24. When the lid 32 is in this closed position there should be adequate friction between the plug 34 and the opening 24 so that a deliberate force will be required to move the lid 32 from the closed position identified in the preceding.

Figure 3:
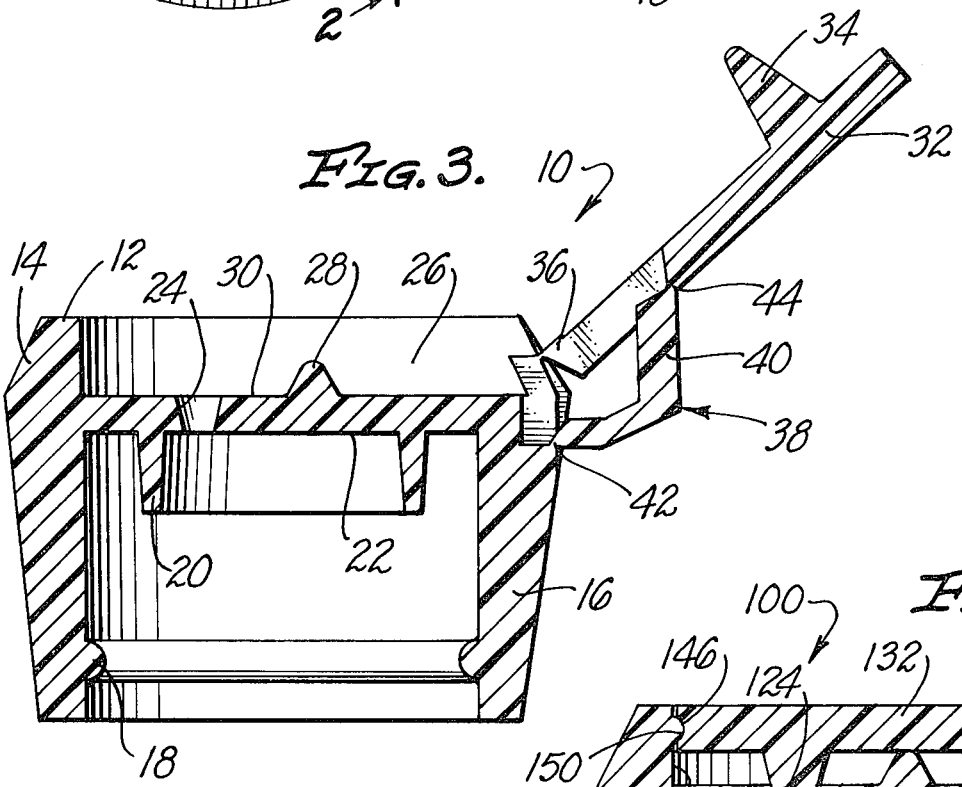
FIG. 3 is a cross-sectional view corresponding to FIG. 2 showing the lid in an open position.

In this closed position the lid 32 rests against the fulcrum 28 and is supported by two hinges 36 connecting the lid 32 and the side 14 of the top 12 in such a manner that the lid 32 may be rotated from the closed position to an open position as indicated in FIG. 3. These hinges 36 may be regarded as hinge means. The lid 32 is also connected to the side 14 of the top 12 through the use of a toggle structure or means 38.

In the illustrated closure 10 this toggle structure 38 takes the form of a bell crank type lever 40 one end (not separately numbered) of which is joined to the side 14 of the top 12 by another hinge or hinge means 42. The other end (not separately numbered) of the lever 40 is joined to the lid 32 along another hinge or hinge means 44. These hinge means 42 and 44 extend in parallel linear paths.

When the lid 32 is in a closed position the lever 40 extends generally along the side 14 and generally along or within the top 12 so as to appear more or less as a part of this top 12. When the lid 32 is rotated from a closed position as shown in FIGS. 1 and 2 to an open position as indicated in FIG. 3 this lever 40 will flex and/or deform some limited extent as the hinges 42 and 44 operate so as to accommodate movement of the lid 32 on the hinges 36. As the lid 32 is moved from this closed position to the open position or vice versa it will pass through what may be referred to as a center-line position enabling a toggle action as described to be achieved.

In order to provide for rotation of the lid 32 from the closed position it is necessary to provide a downwardly directed, vertical force against the lid 32 generally in the region of the hinge 44. Because of the action of this hinge 44 the lid 32 can be pivotted about the fulcrum 28 to a sufficient extent so that a portion of the lid 32 generally remote from the fulcrum 28, the hinges 36 and the toggle structure 38 can be manually engaged and/or engaged with an appropriate manipulative tool so as to be moved to the open position noted.

Although it is technically not necessary it is considered preferable to form the lid 32 in such a manner that it is thin enough to be somewhat capable of limited distortion in the area of this lid 32 generally adjacent to the hinge 44. When the lid 32 is of a stiff character and is incapable of flexure the lid 32 should fit within the recess 26 in the closed position in a more loose or "sloppy fit" type manner than when this lid 32 is of a somewhat flexible, deformable nature in the area noted.

The entire closure 10 is preferably formed of a unitary, one-piece structure by known injection molding techniques out of a material such as polypropylene. Although materials such as various known polyolefins which are related to polypropylene can be utilized in forming the closure 10 it is preferred to form this closure 10 out of polypropylene because of the well known "live-hinge" properties of polypropylene. When the closure 10 is formed as a one-piece closure body as indicated the hinges 36, 42 and 44 consist essentially of elongated lines of reduced thickness as shown. By varying the thickness of any part of the closure 10 the relative flexibility or deformability of the part may be varied as, for example, in providing either a flexible or deformable lid 32 or a rigid lid 32 as indicated in the preceding discussion.

Figure 4:
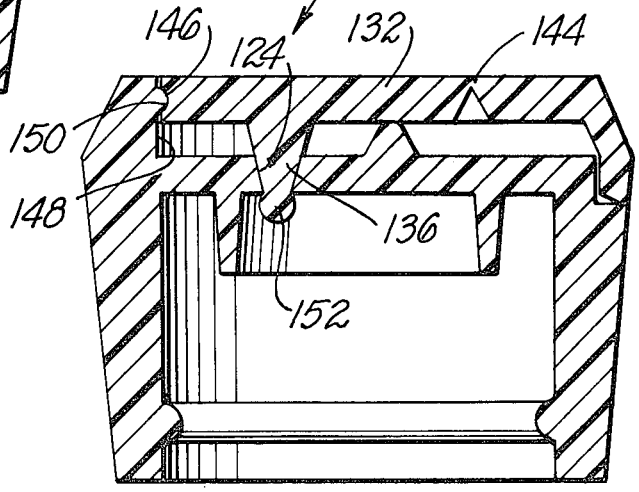
FIG. 4 is a cross-sectional view corresponding to FIG. 2 of a modified dispensing closure in accordance with this invention.

In FIG. 4 of the drawing there is shown a modified closure 100 which is very closely related to the closure 10. For convenience and in the interest of brevity those parts of the closure 100 which are the same or substantially the same as the parts of the closure 10 are not separately described herein and are designated in the drawing and where necessary for explanatory purposes in the remainder of this specification by the numerals previously used to designate such parts preceded by the numeral 1.

The closure 100 differs from the closure 10 in that a small projecting bead 146 is provided on an internal side-wall 148 of the recess 126 for the purpose of engagement with a groove 150 located on the lid 132. This structure is considered to amount to a detent type structure or means tending to hold the lid 132 in such a manner that the application of a relatively small amount of force adjacent to the hinge 144 will not serve to move this lid 132 from a closed position. This is believed to enhance the child resistant properties or characteristics of a closure 100.

Obviously quite a number of similar modifications may be made in the closures 10 and 100. As an example of this the plug 136 may be provided with a small head 152 which is adapted to pop through the opening 124 in order to even more securely hold the lid 132 in place. It is considered that various expedients of this type need not be recited in detail in this specification because they are employed primarily to enhance the value of the fundamental action achieved in the closure 10.

Closures as described are considered to be particularly desirable because of the manner in which they may be molded using comparatively simple molds with the lids to these closures in open positions and because of the fact that these lids may be closed with a minimum of difficulty. The particular closures illustrated are believed to be of such a character that when closed they may be easily assembled upon appropriate containers without danger of damage to any of the hinges employed. Also the closures indicated can either be formed as flat-topped closures as shown for stacking or similar purposes or so as to have specialized shapes or configurations as may be desired by particular customers. These closures illustrated may be utilized to carry adherent labels or the like secured in place on their tops by an adhesive which have to be removed prior to the use of these closures so as to indicate whether or not such closures have been previously opened.

I claim:

1. A container closure having a top with an opening extending therethrough, means for mounting said top on a container attached to said top and extending around said opening, hinge means secured to said top, a lid secured to said hinge means so as to be capable of being rotated between a closed position in which the lid overlies the top and covers the opening and an open position in which said opening is exposed in which the improvement comprises:

a recess having a bottom located in said top of said container, a fulcrum located between said hinge means and said opening extending from the bottom of said recess upwardly into said recess, said lid fitting within said recess when in its closed position so that said lid cannot be manually engaged to be lifted from said closed position, overcenter toggle means connecting said lid and said top for controlling the position of said lid so that said lid is held by the action of said toggle means in either said closed or said open position, said toggle means being located adjacent to said hinge means, said toggle means including a bell crank lever structure having ends, other hinge means pivotally connecting one of said ends of said lever structure to a side portion of said top and further hinge means pivotally connecting the other of said ends of said lever structure to said lid, said lever structure being capable of deflecting as said lid is moved between said open and said closed positions, said toggle means being capable of responding to pressure applied vertically against said further hinge means when said lid is in said closed position so as to pivot said lid about said fulcrum to a sufficient extent so that said lid can be engaged to be further moved to said open position.

2. A container closure as claimed in claim 1 including:

plug means located on said lid and fitting within so as to close off said opening when said lid is in said closed position, said lever structure extends along a side of said top and along said top so as to appear substantially as a part of said side of said top and as a part of said lid, said other hinge means and said further hinge means are elongated hinges located parallel to one another, and said portion of said lid which is sufficiently flexible so as to be capable of being distorted comprises said further hinge means, all parts of said closure are formed integrally with one another of a polypropylene polymer having live-hinge properties.

3. A container closure as claimed in claim 1 wherein:

said lever structure extends along a side of said top and along said top so as to appear substantially as a part of said side of said top and as a part of said lid.

4. A container closure as claimed in claim 3 wherein:

said other hinge means and said further hinge means are elongated hinges located parallel to one another, and said portion of said lid which is sufficiently flexible so as to be capable of being distorted comprises said further hinge means.

* * * * *